United States Patent [19]

Kafkis

[11] Patent Number: 4,713,925

[45] Date of Patent: Dec. 22, 1987

[54] METHOD AND APPARATUS FOR FILLING A PLURALITY OF FLEXIBLE PIPETTE TYPE VESSELS

[76] Inventor: N. H. Kafkis, 8537 Skokie Blvd., Skokie, Ill. 60077

[21] Appl. No.: 872,819

[22] Filed: Jun. 11, 1986

Related U.S. Application Data

[63] Continuation-in-part of Ser. No. 718,489, Apr. 1, 1985, abandoned.

[51] Int. Cl.[4] ..... B65B 31/02

[52] U.S. Cl. ..... 53/432; 53/86; 53/266 R; 141/31

[58] Field of Search ..... 141/7, 31, 61; 53/266 R, 405, 403, 408, 86, 79

[56] References Cited

U.S. PATENT DOCUMENTS

| | | | |
|---|---|---|---|
| 1,259,879 | 3/1918 | Lascoff | 141/31 X |
| 1,345,347 | 7/1920 | Chaney | 141/31 X |
| 1,862,821 | 6/1932 | Henderson | 141/31 X |
| 1,922,458 | 8/1933 | Schaeffer | 141/31 X |
| 2,877,611 | 3/1959 | Anrep | 53/86 |
| 3,282,306 | 11/1966 | Greenhut | 141/7 |

FOREIGN PATENT DOCUMENTS

| | | | |
|---|---|---|---|
| 612720 | 5/1935 | Fed. Rep. of Germany | 53/266 B |

*Primary Examiner*—James F. Coan

*Attorney, Agent, or Firm*—Silverman, Cass, Singer & Winburn, Ltd.

[57] ABSTRACT

A method and apparatus for automatically filling a plurality of flexible vessels or pipettes with liquid in a controlled manner. The vessels are sorted, inserted into a filling rack and then inserted in the rack into a vacuum container with their filling ports or tubes inserted into the liquid. The container and hence the vessels are evacuated to a desired pressure, which then is released to fill the vessels with a desired amount of liquid. The vessels then are removed in the rack and sealed for later use. The sealed vessels then can be labeled prior to use.

19 Claims, 10 Drawing Figures

METHOD AND APPARATUS FOR FILLING A PLURALITY OF FLEXIBLE PIPETTE TYPE VESSELS

RELATED APPLICATION

This application is a continuation-in-part of Ser. No. 718,489 filed Apr. 1, 1985, and now abandoned the disclosure of which is incorporated herein by reference.

BACKGROUND OF THE INVENTION

The invention relates generally to a method and apparatus for filling vessels and more particularly with simultaneously and automatically filling a plurality of flexible pipette type containers or vessels with a liquid to precise levels through a small peripherally locating opening.

In many applications the filling of containers or vessels is carried out by the simple expedient of pouring the liquid into the container. Where controlled flow utilization is desired, a cover may then be affixed to the container, the cover containing a small outlet which is provided with either a valve, cap, or replaceable insert for resealing the container. Where, however, for functional or economic reasons, the container must be made in a single integral flexible piece, but with a small opening for controlled flow, the filling is obviously not so simple, since relief must be afforded for the air which the liquid will displace during the charging process.

There are, however, many applications for flexible vessels or pipettes which have small filling and discharging ports which are, or can be, formed by tubes of small diameters. These vessels can find particular utilization in medical, clinical and laboratory test applications. These flexible vessels can be squeezed to discharge the liquid from the vessels. The flexibility of the vessels is vital to the end use of the vessels or ampules to facilitate vacating the contents of the ampules by simply compressing the sides of the ampules. The vessels can be disposable or resealable for further use.

Because of the small ports, the filling of the vessels can be very tedious and time consuming. One method of filling this type of vessel is to insert a needle into the port and/or tube and to fill the vessel with liquid through the needle. This is only a partial solution to the problem since the liquid is injected into the opening with sufficient needle play to allow the air to escape. The container may, on the other hand, be directly charged or filled without a needle if an air escape is provided elsewhere in the container. Neither solution is completely satisfactory. In the former, the needle must be fairly fine; its dimensions, of course, being dictated by the diameter of the container opening. With fine bore needles, this leads to an excessively slow liquid flow rate. Further, with this arrangement, one must be prepared to meet the high cost inherent in precise positioning jigs and adjunct equipment, and the needles must be periodically flushed and carefully maintained.

The latter or direct filling method is also unsatisfactory because the air escape hole must be subsequently plugged or sealed, thus adding to the cost of charging. Again, the precise positioning of the container opening with respect to the charging apparatus raises the cost of the equipment and its maintenance. Both of these methods require that the vessels be handled one by one or by very complex machinery if filling by an automated system.

One solution is to vacuum fill the container by placing them in a vacuum chamber along with the liquid to fill the containers. The container opening is immersed into the liquid and the chamber and container are first evacuated and then the chamber is vented which forces the liquid into the containers or vessels. Such vacuum filling systems are generally well known, such as disclosed in U.S. Pat. No. 3,282,306. These systems do not, however, provide for automatically filling a plurality of the vessels with a minimal amount of handling.

Prefilled flexible pipette ampules could increase the accuracy of medical, clinical, laboratory and home testing by reducing the potential for human error for each test. Vacuum filling could produce very accurate filling of the vessels at a greatly reduced cost by automatic loading and filling a plurality of the vessels simultaneously. Additional cost savings then could be realized by the user by eliminating costly metering for each test. Additionally, the tests can be accurately conducted by a layman broadening the potential use of this type of product. Further, by eliminating the need for a skilled professional, tests can be conducted in the home or other non-laboratory settings or in field emergency situations.

Therefore, there is a need for a method and apparatus of simultaneously and automatically filling a plurality of flexible vessels with liquid to a precise level with a minimum amount of handling and complex machinery.

SUMMARY OF THE INVENTION

The above and other disadvantages of filling flexible vessels or pipettes with liquid are overcome in accordance with the present invention by providing a method and apparatus for simultaneously and automatically filling a plurality of vessels with a liquid to a precise level with minimal handling. The empty vessels are automatically sorted and loaded into a filling rack. The vessels then are inserted in the rack into a evacuable container with the tubes/ports inserted below the surface of a reservoir of liquid which is to fill the vessels. The container is sealed and evacuated to a predetermined pressure to evacuate the vessels to the desired fill percentage. The pressure in the container then controllably is released to fill each of the vessels with the desired amount of liquid. The vessels then are removed in the rack and sealed. The sealed vessels are unloaded from the rack into a labeling mechanism.

DESCRIPTION OF THE PREFERRED EMBODIMENTS

FIGS. 1–5 illustrate the filling system embodiments disclosed in the parent application, U.S. Ser. No. 718,489.

Figure 1:
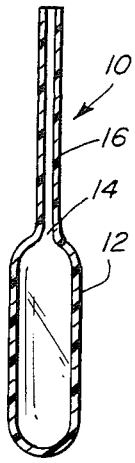
FIG. 1 is a side sectional view of one type of vessel which can be filled utilizing the present invention.

Referring to FIG. 1, a vessel 10 is illustrated which is one type of vessel which can be filled with liquid by the method and apparatus of the present invention. The vessel 10 includes a body portion 12 which is illustrated as a tube, but can have any desired shape. The body 12 includes a filling and discharging port 14, which preferably includes a thin filling and discharge tube 16. The vessel 10 can be made from any convenient material, but preferably will be a semirigid but flexible structure formed, for example, from a polymer.

Figure 2:
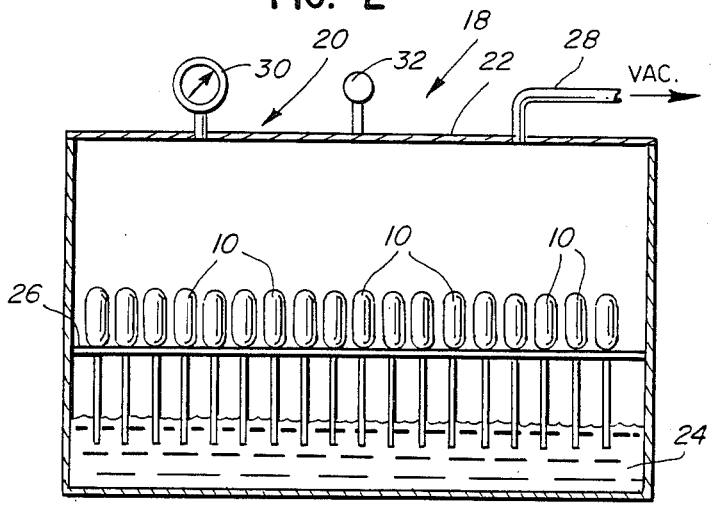
FIG. 2 is a side sectional view of an embodiment of filling apparatus which can embody the present invention illustrated before the vessels are filled.

A plurality of the vessels 10 simultaneously can be filled in an apparatus 18 illustrated in FIG. 2, which can embody the present invention. The filling apparatus 18 includes an evacuable container 20. The container 20 includes a lid 22, which preferably can be removed from the container to load and unload the vessels 10. The vessels 10 are inserted with the tubes 16 into a liquid 24. The vessels 10 preferably are inserted into a rack 26 or in clusters secured to one another to hold the vessels 10 upright in the liquid 24. The rack 26 can be any type of support system for the vessels 10. The liquid 24 could, of course, be added to the container 20 after the vessels 10 are inserted into the rack 26 or the container 20.

Figure 3:
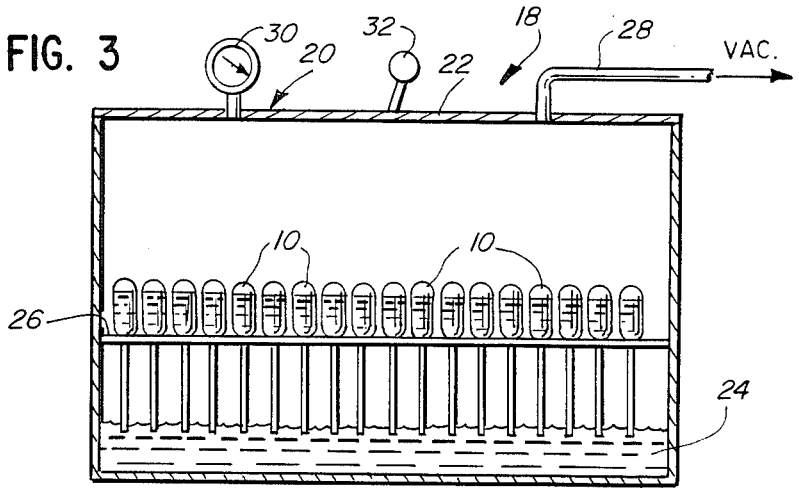
FIG. 3 is a side sectional view of the apparatus of FIG. 2 with the vessels filled with liquid.

The lid 22 is then sealed to the container 20 and a negative pressure is applied to the container 20 from any convenient source, such as a pump (not illustrated) through a vacuum port 28. The vacuum is applied until the desired negative pressure is reached inside the container 20, which can be monitored by a pressure gauge 30. The negative pressure also evacuates the vessels 10 through the liquid 24. When the desired pressure is reached, which is related to the percentage of evacuation and hence filling percentage in the vessels 10, the pressure is released and the vessels 10 are filled with the desired percentage of the liquid 24 as illustrated in FIG. 3. The percentage of evacuation of the container 20 is equal to the percentage of evacuation in the vessels 10, which is substantially equal to the percentage of fill of the vessels 10.

The pressure can be released by a pressure release mechanism, such as a lever 32, which can be any type of pressure release mechanism such as an automatic release valve which can be part of the pressure gauge 30. The pressure release mechanism 32 preferably releases the pressure at a controlled rate. Releasing the pressure at a gradual rate ensures a smooth gradual filling of the vessels 10. The liquid 24 can also be of the type which has material which easily settles out or separates and, in that case, the pressure can be released more quickly which will cause the liquid to be agitated to blend the liquid 24 as the vessels 10 are filled.

The vessels 10 need a controlled, substantially non-drip orifice which can be the port 14, the tube 16 or a fitting which fulfills the function of the tube 16. The orifice size is related to the viscosity of the liquid 24, such that the liquid 24 will not just evacuate the vessels 10 when they are removed from the container 20. The tube 16 could be replaced by a fitting or non-drip cap inserted onto or into the port 14, for filling the vessels 10. The fitting could be a flexible tube with the vessels 10 upright and the fitting or tube inserted into the liquid 24.

Figure 4:
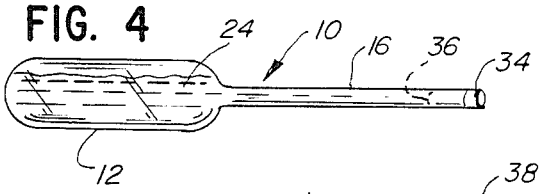
FIG. 4 is a side plan view of one method of sealing a filled vessel.
Figure 5:
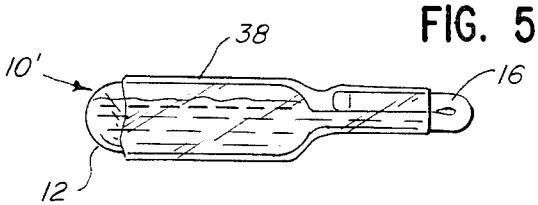
FIG. 5 is a side plan view of a second type of vessel seal.

Once the vessels 10 are filled and removed from the container 20, they preferably are sealed for later use in any one of a number of manners, two types of seals are illustrated by FIGS. 4 and 5. The vessel 10 illustrated in FIG. 4 includes a heat sealed plug 34, which can include a score line 36 in the tube to assist in breaking off the plug to utilize the vessel 10 and discharge the fluid therein. Typically, the body 12 of the vessel 10 can be compressed or crushed to expel the liquid 24 from the open tube 16.

A second type of sealed vessel 10′ is illustrated in FIG. 5. The vessel 10′ includes a conventional heat sealed wrapping 38, which is inserted as a tube over the body 12 and the tube 16 which is bent back upon itself to seal the tube 16. The wrapping 38 is then heat shrunk to fit the vessel body 12 and the tube 16 to secure the sealed tube. The wrapping 38 is removed to utilize the vessel 10′.

The present invention now will be described with respect to FIGS. 6–10.

Figure 6:
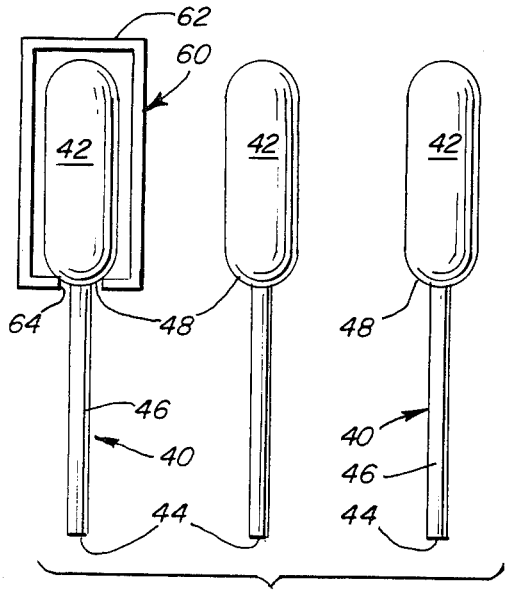
FIG. 6 is a side plan view of a plurality of vessels to be filled in accordance with the invention.

Referring to FIG. 6, a plurality of vessels 40 are illustrated, which can be the same as the vessels 10, and which can be filled with liquid by the method and apparatus of the present invention. Each vessel 40 includes a body portion 42, which is to be filled with liquid and can have any shape, but preferably is in the shape of a tube. The vessel 40 includes a filling port 44 which is formed in one end of a filling and discharge tube 46. The vessel 40 can be formed from any convenient material, but preferably will be a semirigid but flexible structure formed, for example, from a polymer.

The outer dimension of the body 42 is formed to be sufficiently greater than that of the tube 46 to form a support shoulder or flange 48. Further, the vessel or pipette 40 is designed such that the weight of the tube 46 below the shoulder 48 is greater than that of the body portion 42 above the shoulder 48.

Figure 7:
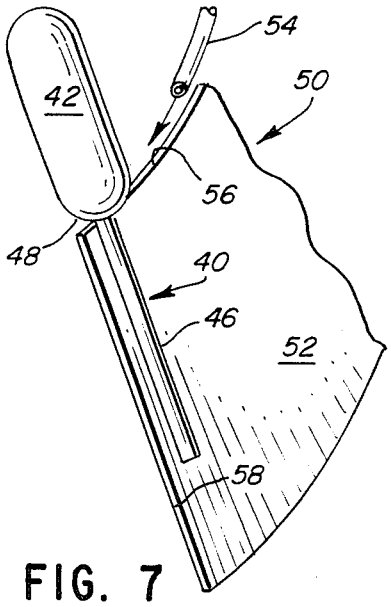
FIG. 7 is a partial perspective view of a sorting mechanism which can be utilized in accordance with the present invention.
Figure 8:
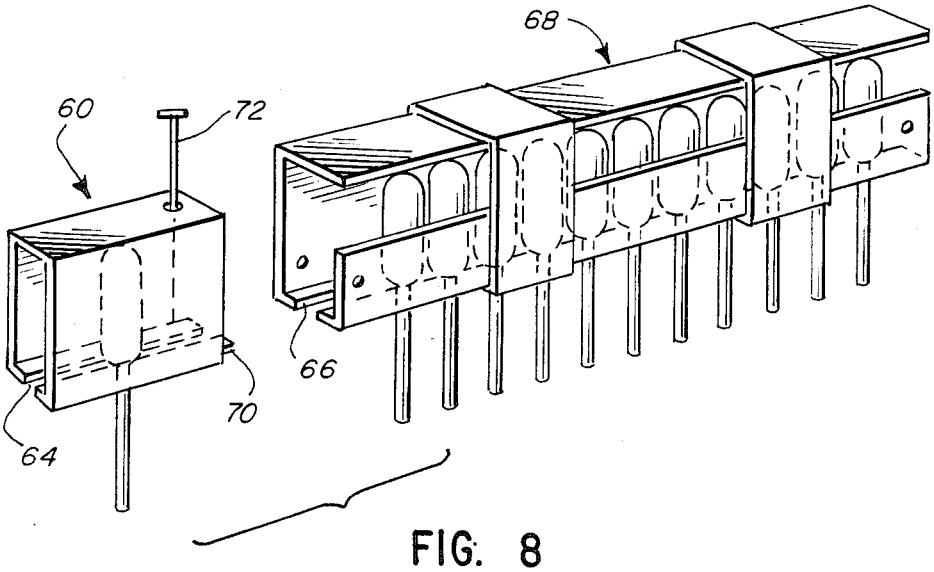
FIG. 8 is a partial perspective view of a vessel loading arm and rack which can be utilized in accordance with the present invention.

The support shoulder 48 functions first to support the vessels 40 in a vibration type sorting apparatus 50, illustrated in FIG. 7. The details of the apparatus 50 are substantially conventional such as sorters utilized to sort aerosol valves. In operation, a plurality of the empty vessels 40 are placed into the sorter 50 without any particular orientation. The sorter 50 includes a vibrating support 52 and an air jet 54.

The sorter 50 aligns each of the vessels 40 separately on an upper edge 56 of the support arm 52. The vibration forces and air jet 54 are utilized to move the vessels 40 one by one to an ejecting end 58 of the sorter arm 52.

Referring again to FIG. 6 and FIG. 8, a vessel loading arm 60 is provided into which the sorted vessels 40 are loaded. The loading arm 60 is a substantially enclosed rectangular body 62, which includes a vessel slot 64 extending along the bottom thereof. The slot 64 is dimensioned to accommodate the width of the tubes 64 of the vessels 40 slidingly therein, but is too small for the shoulder 48 to pass therethrough. The vessels 40 thus rest upon or engage the shoulder or edges of the slot 64, without passing therethrough.

The slot 64 of the loading arm 60 is aligned with the sorter upper edge 56, preferably by being mounted to the sorter 50, and the loading arm 60 then is filled with the sorted and aligned vessels 40 from the sorter 50. The vessels 40 can be fed directly through the loading arm slot 64 into a mating slot 66 in a loading rack 68.

The slots 64 and 66 can be aligned by mounting the rack 68 onto one or more projections 70 extending from one end of the loading arm 60. When a rack 68 is filled or another rack 68 is not ready for loading, the loading arm can be filled by utilizing a stop pin or plunger 72 or other latch mechanism, which can block the open end of the loading arm 60. The pin 72 is removed to fill the next rack 68. The racks 68 are dimensioned to hold any number of vessels 40 desired.

The filled racks 68 then are placed into a vacuum container for filling such as the container 20. The rack or racks 68 can be placed upon the rack or grid 26, with the ports 44 immersed in the liquid 24. The pressure relief mechanism 32 preferably is a conventional ball valve which allows a precise controlled release of the vacuum and hence a controlled fill of the vessels 40.

The percentage filling of the vessels 40 is in direct relationship to the vacuum created in the container 20. This is without regard to the size of the vessels 40, which allows the same percentage fill in different size vessels 40 in one simultaneous operation. A 25% fill is accomplished with a vacuum of 7.5 inches of mercury, a 50% fill with 15 inches of mercury, 75% with 27.5 inches of mercury and 100% with 30 inches of mercury. The release of the vacuum and hence the filling rate is controlled to ensure that the flexible vessels 40 do not collapse.

The container 20 also can be divided such that a plurality of liquids can separately be placed therein (not illustrated). These separate liquids can simultaneously be utilized to fill different vessels 40 in the same operation.

Figure 9:
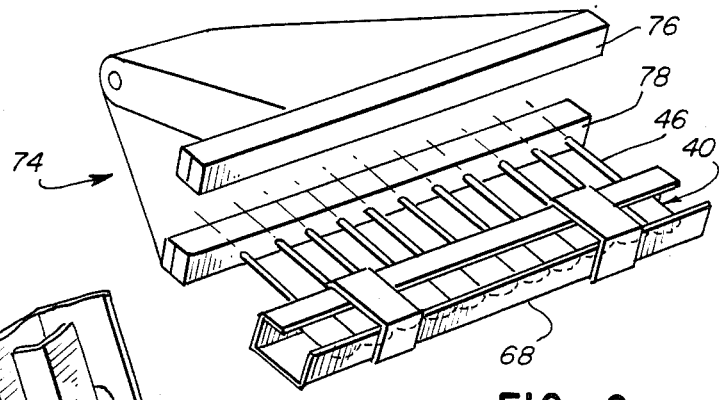
FIG. 9 is a partial perspective view of a sealing mechanism which can be utilized in accordance with the present invention.

Once the vessels 40 are filled to the desired percentage, the rack 68 with the filled vessels 40 therein, is removed from the container 20 and the vessels 40 are then sealed as illustrated in FIG. 9. The tubes 46 are inserted into a sealing mechanism 74 which includes a pair of jaws 76, 78 which clamp and heat seal the tubes 46 to themselves. The tubes 46 then are trimmed or are trimmed in the sealer 75 to eliminate the ends of the tubes 46, which have been immersed in the filling liquid 24.

Figure 10:
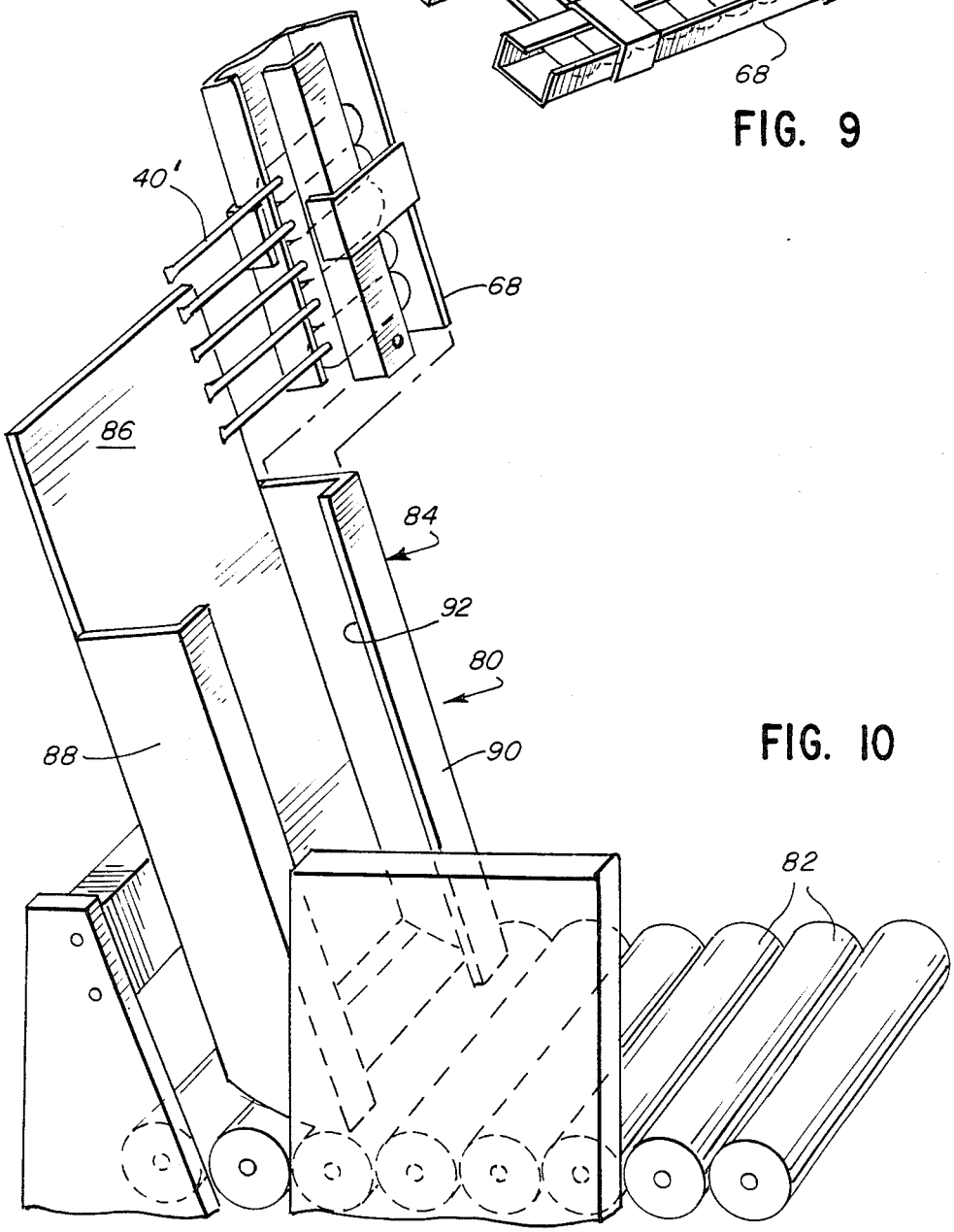
FIG. 10 is a partial perspective view of a labeling mechanism which can be utilized in accordance with the present invention.

The rack 68 then is utilized to transport the sealed vessels or pipettes 40' to a labeling mechanism 80, as illustrated in FIG. 10. The labeler 80 can include a conventional set of labeling rollers 82 onto which the vessels 40' are fed by a loading mechanism 84. The loading mechanism 84 includes an upstanding support panel 86 against which the rack 68 is placed. The loader 86 includes substantially parallel upstanding flanged walls 88, 90 which are sized to allow the feeding of the vessels 40' to the rollers 82 without spilling out of the loader 84. A space of slot 92 between the walls 88, 90 allow for the freeing of any jamming of the vessels 40'. The rack 68 preferably can be mounted on the loader 80 against the panel 86.

There thus is disclosed in accordance with the present invention a method and apparatus for automatically filling a plurality of vessels with a minimum of individual vessel handling. The vessels are sorted and loaded into a filling rack. The vessels are retained in the filling or loading rack 68 while they are filled, removed and sealed prior to labeling and utilization.

Modification and variations of the present invention are possible in light of the above teachings. The vessels 10 (40) are illustrated as being inserted upside down into the liquid 24, but they can be in any orientation as long as the port 14, tube 16 or fitting is below the surface of the liquid. The vacuum port or line 28 can include a conventional liquid trap with the gauge 30 coupled to the line 28 after the trap (not illustrated). The vessels 10 or 40 can be sealed in any number of manners, such as those shown and described in copending application Ser. No. 715,920, entitled "Improved Vessel Closures And Method Of Forming The Closures", in the name of N. Kafkis, filed Mar. 25, 1985, which is incorporated herein by reference. It is therefore to be understood that within the scope of the appended claims, the invention may be practiced otherwise than as specifically described.

What is claimed and desired to be secured by Letters Patent of the United States is:

1. A method of filling a plurality of vessels, comprising:

providing a plurality of vessels having filling ports therein, said vessels having a body at one end and an elongated filling and discharge tube extending therefrom with said port at the end of said tube;

sorting said tubes to align said bodies and said tubes;

providing a loading or filling rack with a slot in one side thereof;

loading said tubes into said loading rack with said tubes extending through said slot;

providing a container for filling said vessels;

filling at least a portion of said container with a liquid with which to fill said vessels;

inserting said rack with said vessels into said container with said filling ports submerged in said liquid;

sealing and evacuating said container to a desired negative pressure to evacuate said vessels;

releasing said pressure to fill said vessels with said liquid;

removing said rack with said filled vessels therein;

providing a sealing mechanism;

inserting said tubes in said rack into said sealing mechanism and sealing said tubes; and providing a labeling mechanism and providing a vessel loading mechanism for said rack and said vessels and unloading said sealed vessels from said rack into said loading mechanism and labeling said vessels after discharging said vessels from said loading mechanism.

2. The method as defined in claim 1 including releasing said pressure in a controlled manner to control the filling of said vessels with said liquid.

3. The method as defined in claim 1 including providing vessel support means in said container to support said rack holding said vessels with said tubes in said liquid and inserting said rack holding said vessels and tubes in said support means to submerge said open ends in said liquid.

4. The method as defined in claim 3 including inserting said vessels and tubes in said support means prior to filling said container with said liquid.

5. The method as defined in claim 1 including evacuating said container and vessels to a desired predetermined negative pressure which is proportional to a desired percentage of evacuation of said vessels and releasing said pressure to fill said vessels with a desired amount of fluid.

6. The method as defined in claim 1 including providing a sorting mechanism with a vibrating sorting arm and sorting and aligning said bodies and tubes in said sorting mechanism and feeding said vessels therefrom, one at a time.

7. The method as defined in claim 6 including providing a loading arm with a slot in one side thereof and feeding said sorted vessels into said locking arm with said tubes extending through said slot and loading said tubes into said loading rack from said loading arm.

8. The method as defined in claim 1 including heat sealing said tubes to themselves to seal said vessels.

9. The method as defined in claim 7 including trimming ends of said tubes after sealing said tubes.

10. An apparatus for filling a plurality of vessels, comprising:

a plurality of vessels having filling ports therein, said vessels having a body at one end and an elongated filling and discharge tube extending therefrom with said port at the end of said tube;

means for sorting said tubes to align said bodies and said tubes;

a loading or filling rack with a slot in one side thereof;

means for loading said tubes into said loading rack with said tubes extending through said slot;

a container for filling said vessels including a liquid with which to fill said vessels;

said rack with said vessels inserted into said container with said filling ports submerged in said liquid;

means for sealing and evacuating said container to a desired negative pressure to evacuate said vessels;

means for releasing said pressure to fill said vessels with said liquid;

said rack removed with said filled vessels therein;

a sealing mechanism;

said tubes in said rack inserted into said sealing mechanism for sealing said tubes; and a labeling mechanism and a vessel loading mechanism for said rack and said vessels and means for unloading said sealed vessels from said rack into said loading mechanism and labeling said vessels after discharging said vessels from said loading mechanism.

11. The apparatus as defined in claim 10 including means for releasing said pressure in a controlled manner to control the filling of said vessels with said liquid.

12. The apparatus as defined in claim 10 including vessel support means in said container to support said rack holding said vessels with said tubes in said liquid and said rack holding said vessels and tubes inserted in said support means to submerge said open ends in said liquid.

13. The apparatus as defined in claim 10 including said vessels and tubes inserted in said support means prior to filling said container with said liquid.

14. The apparatus as defined in claim 10 including means for evacuating said container and vessels to a desired predetermined negative pressure which is proportional to a desired percentage of evacuation of said vessels and means for releasing said pressure to fill said vessels with a desired amount of fluid.

15. The apparatus as defined in claim 10 including providing a sorting mechanism with a vibrating sorting arm and means for sorting and aligning said bodies and tubes in said sorting mechanism and feeding said vessels therefrom, one at a time.

16. The apparatus as defined in claim 12 including a loading arm with a slot in one side thereof and means for feeding said sorted vessels into said loading arm with said tubes extending through said slot and means for loading said tubes into said loading rack from said loading arm.

17. The apparatus as defined in claim 10 including means for heat sealing said tubes to themselves to seal said vessels.

18. The apparatus as defined in claim 14 including means for trimming the ends of said tubes after sealing said tubes.

19. The apparatus as defined in claim 10 wherein said container is rectangular in shape.

* * * * *